US006293625B1

(12) United States Patent
Dixon

(10) Patent No.: US 6,293,625 B1
(45) Date of Patent: Sep. 25, 2001

(54) CHAIRS

(76) Inventor: Barry J. Dixon, PO Box 716, Southport, Queensland 4215 (AU)

( * ) Notice: Subject to any disclaimer, the term of this patent is extended or adjusted under 35 U.S.C. 154(b) by 0 days.

(21) Appl. No.: 08/844,442

(22) Filed: Apr. 18, 1997

(30) Foreign Application Priority Data

Oct. 19, 1994 (AU) ..... PM8912
Oct. 19, 1995 (AU) ..... PCT/AU95/00687

(51) Int. Cl.[7] ..... A47C 7/02

(52) U.S. Cl. ..... 297/452.25; 297/452.26; 297/452.23

(58) Field of Search ..... 297/284.11, 452.24, 297/452.25, 452.26, 452.27, 452.28, 452.23, 452.21; 5/653, 654

(56) References Cited

U.S. PATENT DOCUMENTS

| | | | | |
|---|---|---|---|---|
| 2,412,112 | * | 12/1946 | Wood et al. | 297/452.26 |
| 3,511,537 | * | 5/1970 | Ackermann | 297/452.27 X |
| 3,751,111 | * | 8/1973 | Taylor et al. | 297/452.27 |
| 3,885,257 | | 5/1975 | Rogers . | |
| 3,987,507 | | 10/1976 | Hall . | |
| 4,132,228 | | 1/1979 | Green . | |
| 4,489,982 | | 12/1984 | Morrow . | |
| 4,522,447 | * | 6/1985 | Snyder et al. | 297/452.27 |
| 4,615,563 | * | 10/1986 | Kobayashi | 297/284.11 X |
| 4,682,818 | | 7/1987 | Morell . | |
| 4,696,516 | * | 9/1987 | Yeum | 297/452.27 X |
| 4,744,602 | * | 5/1988 | Campbell et al. | 297/284.11 |
| 4,819,288 | * | 4/1989 | Lowthian | 297/452.27 X |
| 4,951,336 | | 8/1990 | Silverman . | |
| 5,048,137 | | 9/1991 | Rogers . | |
| 5,092,655 | * | 3/1992 | Deegener et al. | 297/452.25 |
| 5,137,333 | | 8/1992 | Chee . | |
| 5,163,737 | * | 11/1992 | Navach et al. | 297/452.25 |
| 5,189,747 | * | 3/1993 | Mundy et al. | 297/452.27 X |
| 5,343,876 | * | 9/1994 | Rogers | 5/653 X |
| 5,395,162 | | 3/1995 | Jay et al. . | |
| 5,414,884 | | 5/1995 | Mackenzie . | |
| 5,469,592 | * | 11/1995 | Johnson | 5/654 |
| 5,720,518 | * | 2/1998 | Harrison | 297/202 X |
| 5,791,736 | * | 8/1998 | Herbert | 297/452.21 |

FOREIGN PATENT DOCUMENTS

| | | | | |
|---|---|---|---|---|
| 479067 | * | 12/1951 | (CA) | 297/452.21 |
| 96249 | * | 2/1898 | (DE) | 297/452.21 |
| 2728754 | * | 1/1979 | (DE) | 297/452.21 |
| 4005075 | | 8/1990 | (DE) . | |
| 291233 | * | 12/1986 | (JP) | 297/284.11 |
| 210825 | * | 2/1967 | (SE) | 297/452.21 |
| 85/00735 | | 2/1985 | (WO) . | |
| 86007528 | * | 12/1986 | (WO) | 297/452.27 |
| 87/07124 | | 12/1987 | (WO) . | |
| 91/03969 | | 4/1991 | (WO) . | |
| 93/00029 | | 1/1993 | (WO) . | |
| 94/06325 | | 3/1994 | (WO) . | |
| 94006327 | * | 3/1994 | (WO) | 5/653 |
| 95/05106 | | 2/1995 | (WO) . | |
| 9506424 | * | 3/1995 | (WO) | 297/452.21 |

* cited by examiner

*Primary Examiner*—Anthony D. Barfield
(74) *Attorney, Agent, or Firm*—Hoffman, Wasson & Gitler

(57) ABSTRACT

A seat (10) for a chair having a base (11) and ridges (13) which extend transversely of the base (11). The ridges (13) are raised and are engaged by the Ischial Tuberosities of a person sitting on the seat (10) to prevent a person sliding from the seat (10).

12 Claims, 2 Drawing Sheets

CHAIRS

CROSS REFERENCE TO RELATED APPLICATION

This application is a Continuation-in-Part of co-pending PCT International Application No. PCT/AU95/00687 (designating the United States), filed on Oct. 19, 1995, which PCT application claims priority to Australian Application No. PM 8912, filed on Oct. 19, 1994.

TECHNICAL FIELD

This invention relates to improvements to chairs and in particular to an improved meet design and support therefore. The present invention has particular but not exclusive application to chairs of the type which have a forwardly tilted seat or a seat which allows for some degree of forward tilting movement.

A seated person's weight is largely born on, and balanced over the Ischial Tuberosities of the pelvis and their posture is largely determined by the front to rear rotation of the pelvis. If the knees are elevated higher than the hips, the pelvis is tilted back and a less desirable posture results.

BACKGROUND ART

Chairs of many different designs are currently available. In many chair designs, the most common seat configuration in one in which the seat Is substantially flat and disposed with a slight backward tilt. This configuration induces an undesirable seated posture and creates a transverse pressure ridge against the underside of the user's legs.

In improved chair designs, the seat is provided with a forward tilt to encourage a more erect posture and the correct lordosis of the lower back. When using such chair designs, the knees are lower than the hips and the normal curve of the spine is encouraged. As the tilt of the chair seat increases however, means are required to be provided to prevent a person seated on the chair from sliding off the seat.

The use of knee rests is common for such purposes, however knee rests create certain difficulties as considerable pressure Is applied to the knees which can thus be aggravated. Furthermore, chairs of this design reduce the freedom of movement of the person's posture and additionally the chairs themselves are more cumbersome Various seat contours have also been proposed to prevent sliding from a tilted seat. Most however have as their principal object the restraint of sliding and thus are not adapted for comfortable effective seating. For example, one earlier proposal utilises a seat contour formed with a transverse V-shaped recess which would not be particularly comfortable in use. Others provide a forward-elevating central ridge which would also be uncomfortable for many users.

Furthermore, these arrangements do not maintain a desired posture wherein the skull, neck, lower backbone and Ischial Tuberosities of the pelvis are substantially maintained in vertical alignment while the user's weight is transferred to a relatively flat horizontal surface.

Also, in many prior proposals tilting seats are considered desirable. In this respect it is believed that small amplitude tilting movements of the spine stimulate nutrient secretion to the spine. However most use conventional tilting arrangements which result in the user's body being raised and lowered with the tilting action This changes the body's height in relation to the desk which is most undesirable. Thus the desired relationship between hip and knees and the desk at which the person is seated is varied with the tilting. Furthermore when in a tilted position, offset pressure must be applied to the seat in order to maintain the desired tilted attitude. This further reduces the relaxed attitude of the user's body and increases stress.

The present invention aims to alleviate one or more of the above disadvantages.

SUMMARY OF THE INVENTION

The present invention in one aspect thus provides a seat for a chair having:

- a rigid base formed with a front edge portion which curves downward relative to a main supporting portion;
- a layer of padding covering the base, and
- mounding means disposed in the front portion of the base and forming a low mound in the upper surface of the padded covering in front of each Ischial Tuberosities which tapers forwardly towards the front edge portion and rearwardly towards the back portion of the base and against which respective opposed forward portions of a user's Ischial. Tuberosities may engage.

This arrangement provides a dished supporting portion beneath the Ischial Tuberosities which maintains a substantially level supporting surface beneath the Ischial Tuberosities and a forward-elevating surface in front of the Ischial Tuberosities when the base is tilted forwardly. Thus the seat base may be tilted forwardly through a limited angle while maintaining a desirable supporting contour for the user.

Preferably the mounding means forms respective laterally spaced apart mounds providing a gap or trough therebetween to prevent excess pressure being applied to the front of the centre of the pelvis and adjacent body parts. The mounding means in cross-section suitably has a curved upper surface forming an external substantially convex configuration.

The mounding means Is suitably formed as spaced part cylindrical sections disposed with their longitudinal axes either substantially transversely aligned with each other or angled to each other such that their axes extend from the sides of the seat towards the front of the seat.

The mounding means may be provided by the base of the seat, by an Insert or inserts in or on the seat or by a suitably shaped cushion on the base of the seat. Where defined by the base of the seat, the base may be shaped to incorporate the mounding means and be covered by suitable cushioning such as a constant thickness foam plastics sheet or other resilient material. Where defined by an insert or inserts, the insert or inserts are suitably interposed between the base of the seat and cushioning. Where defined by the cushioning applied to the base of the seat, the cushioning is suitably shaped to define the mounding means.

The seat configuration of the invention may be applied to chairs having a seat of fixed inclination or of a variable inclination. Preferably the seat is applied two a variable inclination support in which the seat is supported for fore and aft tilting motion about a transverse pivot which, in use, may be substantially in vertical alignment with the skull, neck, lower backbone and Ischial Tuberosities of a user comfortably seated upon the seat. This arrangement has the advantage that the user's body is not significantly raised and lowered with the tilting action. Thus the user adjusted relationship, by seat height adjustment, between hip and knees is maintained. In addition as the user's weight is applied through the pivot offset pressure need not be applied to the seat in order to maintain the desired tilted attitude.

In a further aspect, this invention resides in a chair seat support of the type utilising a leaf or torsion spring having upper and lower end portions which connect to the seat bass and the support means respectively to springedly support the seat base relative to the support means, and hereinafter referred to collectively as "U-shaped spring means", said chair support including:

support means providing an elevated seat support;

U-shaped spring means having a lower end portion fixed to the support means and an upper end portion fixed to the seat base, and characterised in that the portion of the U-shaped spring means which spans between the upper and lower end portions, hereinafter referred to as the spanning portion, is disposed substantially centrally of the seat base to permit a user to move when supported by the seat bass to a position at which the seat base is tilted forwardly while its medial position above the spanning portion remains at a substantially constant elevation.

Preferably the support means is a central strut type support which is height adjustable and the U-shaped spring means comprises a pair of laterally spaced apart U-shaped springs in which the spanning portion between the upper and lower end portions is a substantially part-cylindrical springing portion. The use of U-shaped springs is preferred over the use of torsion springs as, in addition to providing spring for the tilting action, U-shaped springs also provide minimal vertical springing for the supported seat.

Suitably the substantially part-cylindrical spanning portion has a radius of between 1 ⅛" and 3 ¼". In a preferred embodiment each U-shaped spring is formed as a spring steel leaf spring having a width of between 1" to 2", a thickness of between ⅛" and ¼", and a spanning portion radius of between ⅝" and 1 ½". Suitably the thinner sectioned springs are used for supporting average weight adults and the thicker section springs are used for supporting heavy adults.

It is also preferred that the upper and lower end portions diverge outwardly from the spanning section and that they be mounted to extend rearwardly of the spanning section so that the seat base is freely supported in an inclined attitude. Suitably the upper and lower end portions diverge outwardly from the spanning section with an included angle of between 5° and 10°. However if desired the spanning section can be disposed at the rear of the end portions which would then preferably converge towards one another away from the spanning section.

Furthermore it is preferred that the spanning portion be disposed forwardly of the axis of the strut and suitably about 2" in front of the strut. The end portions may also be provided with movement limiting means which limits the tilting extent afforded by the U-shaped spring, such as a buffer for limiting compression and a stay for limiting recoil and preferably the limiting means are adjustable.

The seat for a chair as variously defined above is preferably supported by a fore and aft pivot mounting of any suitable type and which suitably provides a bias to a selected inclined seated position. More preferably however, the seat for a chair as variously defined above is supported by the seat support as variously defined above. Similarly, the seat support as variously defined above may be utilised with conventional chair seats as well as the seat for a chair as variously defined above.

BRIEF DESCRIPTION OF THE DRAWINGS

In order that the invention may be more readily understood and put into practical effect, reference will now be made to the accompanying drawings which illustrate -a preferred embodiment of the invention and wherein.

DETAILED DESCRIPTION OF THE EMBODIMENT

Figure 1:
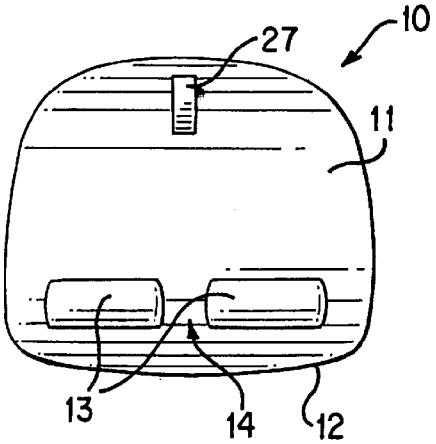
FIG. 1 illustrates schematically in plan view a seat of a chair according to the present invention with covering and padding removed.
Figure 8:
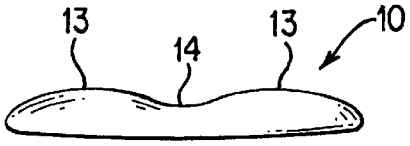
FIG. 8 is a front elevation of the seat illustrated in FIG. 1, FIG. 9 diagrammatically illustrates the seat in use supported by a preferred for of support.
Figure 2:
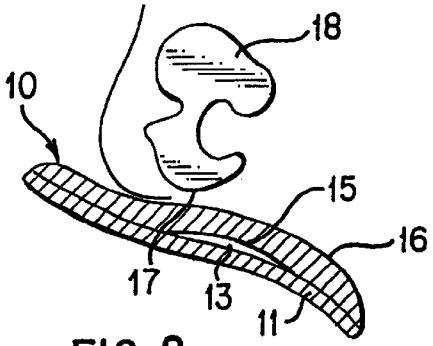
FIGS. 2 and 3 illustrate in sectional view the seat of FIG. 1 in an extreme tilted position and a normal position respectively.
Figure 3:
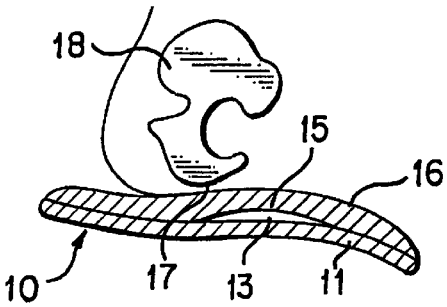
Figure 9:
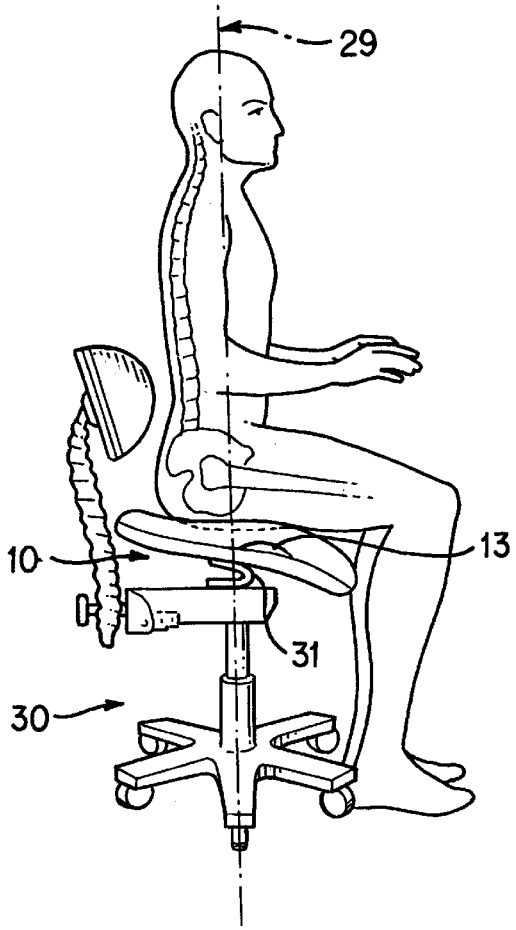

Referring to the drawings and firstly to FIG. 1 there is illustrated a chair seat 10 according to the present invention, including a bass portion 11 of a generally conventional perimeter shape and having adjacent, but rearwardly of Its forward or leading edge 12, a pair of raised mounding means 13 which form ridges which extend generally transversely of the bass portion 11, being generally in alignment with each other. The mounding means 13 are spaced apart to define a gap 14 therebetween, As shown more clearly in FIGS. 2 and 3, the mounding means 13 have In cross-section a convex upper surface 15. In the embodiment of FIGS. 2 and 3 the mounding means 13 are shown as inserts and are covered by a cushioning material 16 such as a foam plastics material. The seat 10 is normally tilted downwardly and forwardly and may be fixed at different inclinations as shown in FIGS. 2 and 3 or may be adjustable between those inclinations such as by being pivotally mounted to the frame of the chair. In the tilted positions, as shown in FIGS. 3 and 9, the Ischial Tuberosities 17 of the pelvis 18 is on an effectively level surface due to the shape and position of the mounding means 13.

This enables the muscular and skeletal structures with the upper legs sloping downward to encourage the slightly forward tilted position of the pelvis 18 required for maintaining the normal spinal curvature in a balanced sitting posture. The mounding means 13 forwardly of the level support of the Ischial Tuberosities reduce the tendency to slide off the seat.

Figure 4:
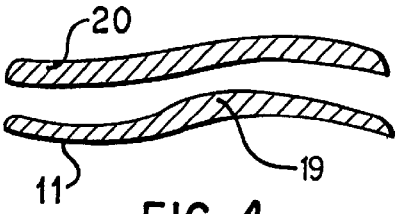

The mounding means 13 in the chair seat 10, may be defined through a number of alternative arrangements. For example, as shown In FIG. 4, the base portion 11 of the seat 10 is provided with an integral convex deformation or deformations 19 which define the mounding means 13. Padding or cushioning 20 is then applied over the base portion 11, the padding or cushioning following the profile of the convex deformation 19.

Figure 6:
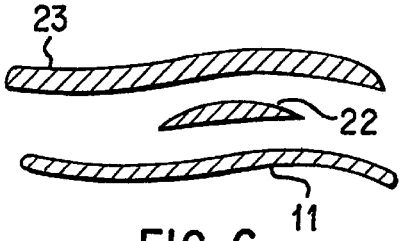
FIGS 4, 5, and 6 illustrate alternative constructional details of the seat of the invention.
Figure 5:
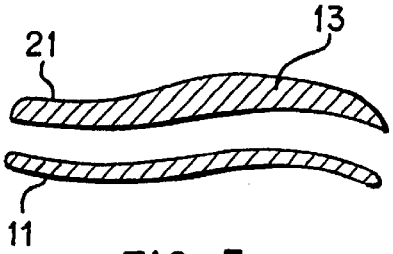

In the configuration of FIG. 5, the base portion 11 of a standard form and the mounding means 13 are defined within or by foam padding 21, the padding 21 being thickened to form the mounding means 13. In the configuration of FIG. 6, the base portion 11 is again of conventional form and the mounding portions 13 are defined by separate inserts 22 interposed between the base portion 11 and padding 23. Any of the configurations described above will be effective in defining the mounding means 13.

Figure 7:
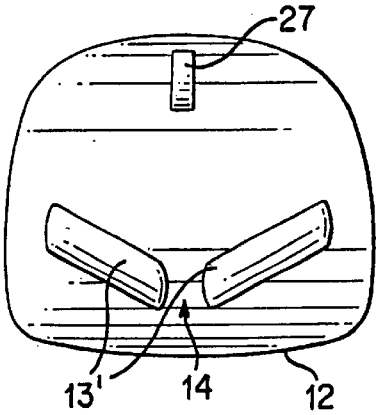
FIG. 7 illustrates schematically in plan view an alternative seat configuration according to the invention.

In the preferred form of the seat 10 of the invention the mounding means 13 are separate and extend substantially parallel to each other and are aligned as shown in FIG. 1. In the configuration of FIG. 7, however, the mounding means 131 may be angled inwardly towards each other and the leading edge 12 of the base portion 11.

Whilst the mounding means 13 and 13' are shown as separate elements, they may be continuous across the base portion 11 in which case the gap 14 is eliminated. For the purposes of comfort however, the gap 14 is preferably provided between the mounding means 13 or 13'.

Furthermore, whilst the mounding means 13 are shown to have a convex upper configuration, they may have other cross-sectional configurations. For example, the mounds 13 may be of a somewhat triangular form in cross-section with the apex uppermost or alternatively of rectangular form in cross-section. The mounding means 13 may also be of other cross-sections which will perform the function described above and which will provide comfort to the user of the seat 10.

In each of above configurations, it will be apparent that the thickness of the seat 10 in the region of the mounding means 13 is greater than in regions away from the mounding means 13. In some configurations however, the seat 10 may be of a constant thickness where for example the base portion 11 is shaped to form the mounding means 13. For example, the base portion 11 may be formed of a rigid sheet of substantially constant thickness which may be shaped to define the mounding means 13. The padding or cushioning then may be of a constant thickness applied over the base portion 11.

The base portion 11 of the seat 10 may be formed of any suitable material such as timber, metal or plastics and the padding for the seat may comprise any cushioning material such as a resilient plastics material. The seat 10 is normally incorporated into office-type chairs however it may be used In many different styles of chairs. Preferably the seat 10 also contains a cutout 27 at its rear central portion to relieve pressure on the coccyx.

Figure 10:
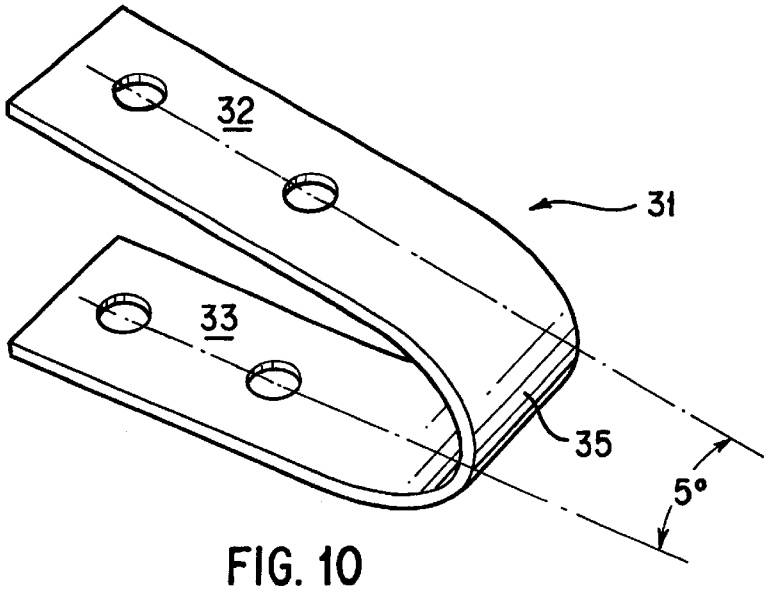
FIG. 10 is a perspective view of a preferred form of torsional mounting seat spring.

Referring to FIGS. 9 and 10 it will be seen that the torsional mounting of the seat 10 upon a supporting bass 30 is suitably achieved by providing a pair of U-shaped springs 31 laterally spaced apart and disposed with the spring fulcrum substantially in line with the support axis 29 of a person comfortably seated on the seat 10. This axis 29 or the transverse plane in which it is contained passes through the skull, neck, lower backbone and Ischial Tuberosities of the pelvis.

It will be seen that each U-shaped spring 31 has an upper end portion 32 and a lower and portion 33 which are apertured to enable them to be bolted to the seat base 11 and the supporting base 30 respectively. These portions are interconnected by a part circular spanning portion 35 having a radius of about ¾". The spring 31 is formed from spring steel leaf which is 2" wide and ⅛" thick and the end portions diverge at °5. This provides an operative springing movement, which is translated into pivoting and minimal vertical spring of the seat base, of between 1 ¾" between end portions when unloaded and ¾" when loaded by a normal weight adult. The included angle between the portions 32 and 33 is 5°.

A user may pivot the sent base 10 to a forward tilt which suits them without effectively raising or lowering of the seat portion above the spanning portion 35 on which the Ischial Tuberosities is supported. In addition a user may easily rotate to and fro about the axis of the chair strut 36 without adversely affecting their good posture or comfort. Furthermore, a seated user may also readily rotate and tilt their hips either simultaneously or independently.

Whilst the above has been given by way of illustrative embodiment of the invention, all such modifications and variations thereto as would be apparent to persons skilled in the art are deemed to fall within the broad scope and ambit of the invention as herein defined in the appended claims.

What is claimed is:

1. A seat for a chair comprising a rigid base having front rear, and side edges defining a substantially rectilinear seating surface characterized in that the rear section of the seating surface adjacent the rear edge of the base provides a substantially planar seating surface and the front section of the seating surface has two laterally spaced mounds each of the mounds providing convex surfaces which taper forwardly and downwardly towards the front edge of the base and rearwardly and downwardly towards the rear section of the base, wherein the mounds are part-cylindrical sections disposed with their longitudinal axes extending transversely on the rigid base and being substantially aligned with each other.

2. A seat for a chair comprising a rigid base having front rear, and side edges defining a substantially rectilinear seating surface characterized in that the rear section of the seating surface adjacent the rear edge of the base provides a substantially planar seating surface and the front section of the seating surface has two laterally spaced mounds each of the mounds providing convex surfaces which taper forwardly and downwardly towards the front edge of the base and rearwardly and downwardly towards the rear section of the base, wherein the mounds are part-cylindrical sections disposed with their longitudinal axes angled to each other such that their axes extend from sides of the seat towards the front of the seat.

3. A seat for a chair as claimed in claim 2, wherein the mounds are provided as inserts beneath a padded cover covering the rigid base.

4. A seat for a chair as claimed in claim 3, wherein the rigid base is shaped to incorporate the mounds and the padded cover covering the base is of substantially constant thickness.

5. A seat for a chair as claimed in claim 2, wherein the mounds are formed integrally with the ridge base.

6. A seat for a chair as claimed in claim 2, wherein the seat is supported by a variable inclination support which supports the seat for fore and aft tilting motion about a transverse pivot.

7. A seat for a chair as claimed in claim 2, wherein a space between the mounds provides a concave trough.

8. A seat for a chair as claimed in claim 1, wherein the mounds are provided as inserts beneath a padded cover covering the rigid base.

9. A seat for a chair as claimed in claim 1, wherein the mounds are formed integrally with the ridge base.

10. A seat for a chair as claimed in claim 8, wherein the rigid base is shaped to incorporate the mounds and the padded cover covering the base is of substantially constant thickness.

11. A seat for a chair as claimed in claim 1, wherein the seat is supported by a variable inclination support which supports the seat for fore and aft tilting motion about a transverse pivot.

12. A seat for a chair as claimed in claim 1, wherein a space between the mounds provides a concave trough.

* * * * *